US006796747B1

(12) United States Patent
Vreeland

(10) Patent No.: US 6,796,747 B1
(45) Date of Patent: Sep. 28, 2004

(54) APPARATUS FOR INSTALLING A SILT FENCE AND SUPPORT POSTS

(76) Inventor: Gregory M. Vreeland, 1217 Lyons Rd., Centerville, OH (US) 45458

( * ) Notice: Subject to any disclaimer, the term of this patent is extended or adjusted under 35 U.S.C. 154(b) by 0 days.

(21) Appl. No.: 10/453,365

(22) Filed: Jun. 3, 2003

(51) Int. Cl.[7] ..... E02D 7/02; E02B 7/02; E01F 7/02

(52) U.S. Cl. ..... 405/302.7; 405/302.6; 405/176; 405/115; 173/90; 173/184; 256/12.5; 37/403

(58) Field of Search ..... 405/36, 80, 302.6, 405/302.7, 114–116, 176, 157, 180, 183, 302.4, 259.1; 173/90, 114, 184; 37/367, 403, 466, 142.5; 256/12.5

(56) References Cited

U.S. PATENT DOCUMENTS

| | | | | |
|---|---|---|---|---|
| 3,182,459 A | | 5/1965 | Grether et al. | |
| 3,218,810 A | * | 11/1965 | Grether et al. | 405/107 |
| 3,298,183 A | * | 1/1967 | Grether et al. | 405/36 |
| 3,722,861 A | * | 3/1973 | Anderson | 173/184 |
| 4,261,400 A | | 4/1981 | Spence | |
| 5,282,511 A | | 2/1994 | Burenga et al. | |
| 5,494,117 A | | 2/1996 | Aldridge | |
| 5,915,878 A | | 6/1999 | Carpenter | |
| 6,053,665 A | * | 4/2000 | Richardson | 405/302.6 |
| 6,158,923 A | | 12/2000 | Wheeler et al. | |
| 6,398,459 B1 | | 6/2002 | Vreeland | |
| 6,517,294 B2 | | 2/2003 | Vreeland | |

FOREIGN PATENT DOCUMENTS

| | | | |
|---|---|---|---|
| EP | 257191 | * | 3/1988 |

* cited by examiner

*Primary Examiner*—Jong-Suk (James) Lee
(74) *Attorney, Agent, or Firm*—Jacox, Meckstroth & Jenkins

(57) ABSTRACT

A tractor carries a vertically adjustable frame supporting a horizontal shaft for a supply roll of silt fence fabric. A vertical plow blade is mounted on the frame, and a vertical fin is supported directly behind the plow blade by a horizontal fabric guide bar attached to the frame. The fin receives an intermediate portion of the fabric directed around the guide bar for folding an edge portion of the fabric into a slot formed within the ground by the plow blade. The frame also supports a hydraulically actuated stake driver rearwardly of the supply roll and directly above the folded edge portion of the fabric. In one form, the stake driver comprises a vertically sliding ram having wide steps for receiving different length stakes. In another form, the stake driver comprises an impact hammer attached to a vertically and horizontally adjustable boom carried by the frame.

20 Claims, 4 Drawing Sheets

106
104
107
133
115
104
132
130
126
118
95
25
121
124
124
123
102
80
31
31
26
126
68
10
103
32
28
14
90
86
36
34
43
92
44
82
70
12
83
34
43
80
66
78
75
56
76
62
50
58
45

APPARATUS FOR INSTALLING A SILT FENCE AND SUPPORT POSTS

BACKGROUND OF THE INVENTION

The present invention relates to apparatus for installing a longitudinal edge portion of a fabric silt fence into the ground so that a major portion of the fabric projects above the ground and is supported by longitudinally spaced vertical stakes. Such apparatus is disclosed in U.S. Pat. No. 6,398,459 and No. 6,517,294 which issued to applicant and the disclosure of which is herein incorporated by reference. The '294 patent also discloses a hydraulically actuated stake driver which is mounted on one side of a tractor supporting the silt fence installing apparatus. Other forms of silt fence installing and/or stake driver apparatus are disclosed in the references cited in the above '459 and '294 patents and include U.S. Pat. No. 3,182,459, No. 4,261,400, No. 5,282,511, No. 5,915,878 and No. 6,158,923. In addition, U.S. Pat. No. 5,494,117 discloses a metal fence post or stake driver which includes a hydraulically actuated hammer or reciprocating unit which is placed on the top end of a post or stake to be driven into the ground.

SUMMARY OF THE INVENTION

The present invention is directed to improved apparatus for rapidly inserting a longitudinal folded edge portion of an elongated flexible silt fence material into the ground and for efficiently inserting fence support stakes into the ground adjacent the edge portion and at longitudinally spaced intervals immediately after the edge portion is inserted into the ground. The apparatus of the invention also provides for overlying the silt fence portion lying on the ground with a wire fence backing when such backing is required in a territory.

In accordance with one embodiment of the invention, a silt fence installing apparatus is constructed substantially as disclosed in the above mentioned '459 and '294 patents and includes a frame adapted to be attached to a tractor by a conventional three point hitch, and the frame supports a horizontal supply roll of silt fence fabric or material. A generally vertical plow blade is mounted on the frame for cutting a slot within the ground in response to forward movement of the tractor. A fence inserting fin member is supported by a material guide bar secured to the frame for receiving an intermediate portion of the silt fence material and for progressively guiding a folded edge portion of the silt fence material into the slot formed within the ground by the plow blade.

Positioned rearwardly of the supply roll is a hydraulically actuated stake driver which is supported by the frame for driving elongated stakes into the ground adjacent the folded edge portion of the silt fence inserted into the ground. In one embodiment, the stake driver includes a vertically sliding ram having stepped surfaces for engaging different length stakes and operated by a vertical double acting hydraulic cylinder supported by frame. In another embodiment, the stake driver includes a hydraulically actuated impact hammer which is suspended by swivel fitting connected to the rearward end portion of a generally horizontal boom having a forward end portion pivotally supported by a telescopic support post mounted on the frame. Hydraulic cylinders are connected to lift the boom and the impact hammer and also to rotate the support post for precisely positioning the impact hammer directly above the folded edge portion of the silt fence inserted into the ground. The frame also supports a rearwardly open container or box which carries a supply of silt fence support stakes. The frame also has an optional attachment which supports a center shaft for a roll of wire fence material which unrolls in overlapping relation on the fabric silt fence when wire fence material is required for backing the fabric silt fence attached to the stakes.

Other features and advantages of the invention will be apparent from the following description, the accompanying drawings and the appended claims.

DESCRIPTION OF THE PREFERRED EMBODIMENTS

Figure 1:
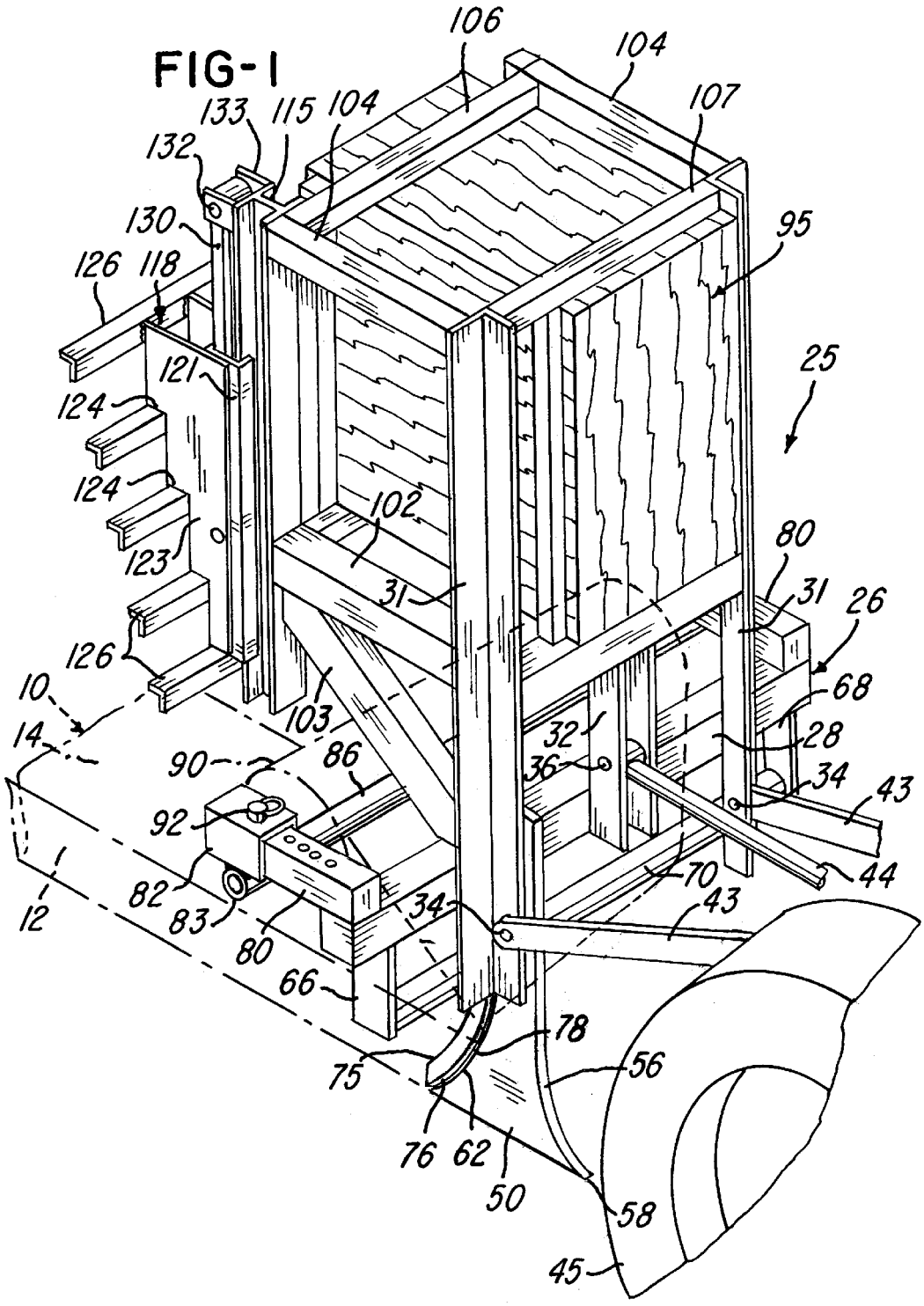
FIG. 1 is a perspective view of a combined silt fence installing apparatus and one form of stake driving apparatus, both constructed in accordance with Applicant's invention.
Figure 2:
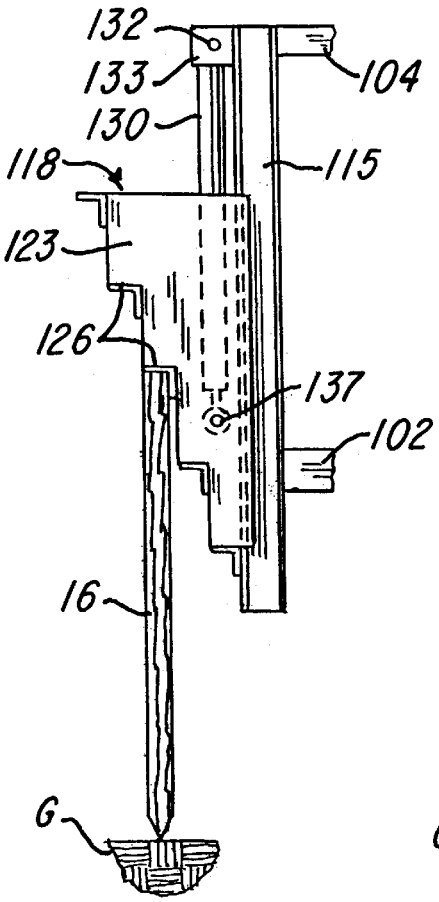
FIGS. 2 and 3 illustrate the operation of the stake driver shown in FIG. 1 for driving a post or stake into the ground.
Figure 3:
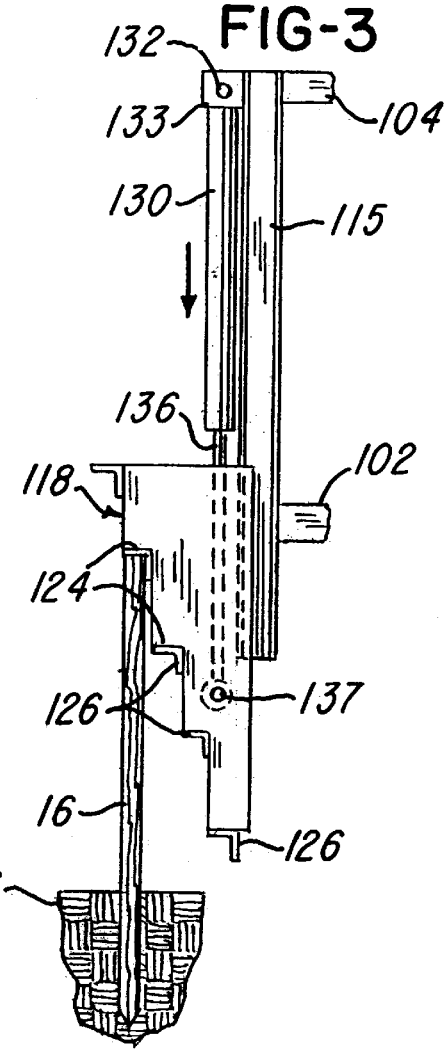

FIG. 1 illustrates in phantom a woven fabric silt fence 10 which has a lower folded edge portion 12 buried within a slot formed in the soil or ground. Typically, the folded edge portion 12 has a width in the range of 6" to 8", and an upper portion 14 of the fabric silt fence 10 which initially overlies the ground is on the order of 16" or more. The upper portion 14 of the silt fence is retained in a generally vertical position by a series of longitudinally spaced support posts or stakes 16 (FIGS. 2 and 3). The stakes 16 are driven into the ground at longitudinally spaced intervals, for example, eight to ten feet, adjacent the folded lower edge portion 12 of the silt fence after the fence is inserted into the ground. The stakes may be conventional wood 2"×2" stakes or conventional T-shaped metal fence posts or other forms of stakes.

Referring to FIGS. 1–3, the folded lower edge portion 12 of the silt fence 10 is inserted into the soil or ground G by apparatus 25 which includes a fabricated steel frame 26 having a square cross tube 28 with a pair of vertical angle members 31 and a channel member 32 welded to the front face of the cross tube 28. A pair of horizontal hitch pins 34 are welded to the angle members 31 and horizontally-aligned holes are formed in the channel member 32 to receive a pivot pin 36. The pivot pin 36 cooperates with the pins 34 to form a conventional three point hitch for attaching the frame 26 to a pair of hydraulically controlled lift arms 43 and to a center or top link rod 44, projecting rearwardly from a conventional small farm tractor having a pair of rear wheels 45.

A flat vertical plow blade 50 (FIG.1) has a uniform thickness, for example, one inch, and includes an upper portion secured to the adjacent angle member 31. The plow blade 50 has a downwardly and forwardly curved front surface 56 which cooperates with a flat bottom surface to form a leading cutting edge 58. The plow blade 50 also has a downwardly and rearwardly curved rear surface 62 which provides the plow blade with a generally inverted Y configuration. A set of downwardly projecting and laterally spaced plates or brackets 66 and 68 are welded to the cross tube 28 of the frame 26 and support a horizontal fabric guide tube or bar 70 having opposite ends welded to the brackets 66 and 68. A rearwardly projecting bracket or plate 71 (FIG. 6) is welded to the guide bar 70 at a location spaced inwardly from the end of the bar, and a pair of bolts connect the bracket to a vertical fin 75 having a downwardly and rearwardly curved front surface 76. The fin 75 is thinner than the plow blade 50, for example, on the order of ¼ inch, and the curved front surface 76 on the fin 75 cooperates with the curved rear surface 62 on the plow blade 50 to define a downwardly and rearwardly extending curved slot 78 having a uniform width of about ¼ inch.

A pair of parallel spaced elongated horizontal arms or square tubes 80 have forward end portions welded to the ends of the cross tube 28 of the frame 26, and larger square tube sections 82 are slidable on the tubes 80. The tubes 82 carry sockets 83 which receive opposite end portions of a substantially horizontal support rod or axle 86. The axle 86 extends through the center cylindrical core of a supply roll 90 of the fabric silt fence 10. The fabric silt fence is coiled into the roll 90 and has a width of about thirty inches, but the apparatus may be constructed to handle a wider or narrower web. The tube sections 82 are adjusted forwardly relative to the guide tube 70 as the roll decreases in diameter. Retaining pins 92 secure the tube sections 82 and shaft 86 in a selected position.

As also shown in FIG. 1, a container in the form of a wood box 95 is supported above the supply roll 90 by extensions of the frame 26, including a pair of horizontal lower tubes 102, inclined brace tubes 103 and horizontal upper tubes 104 rigidly connected or welded to the vertical angles 31. The tubes 102 and 104 and angles 31 are also welded to cross frame tubes 106 and 107. The box 95 has a rear opening and supports or carries a supply of stakes 16 so that they are conveniently accessible from the rear of the apparatus 25 during installation of the silt fence 10.

A vertical "H" beam 115 is welded to the right rear corner of the fabricated frame 26 and forms a guide track for a vertically movable ram 118 having angles 121 which receive and capture the rear flange of the beam 115.

The ram 118 includes a pair of parallel spaced side plates 123 which have stepped surfaces 124 on which are welded horizontal angle strips 126 forming stepped surfaces for engaging the top end of a stake 16, as shown in FIGS. 2 and 3. A double acting hydraulic cylinder 130 is supported in a vertical position by a cross pin 132 extending through a pair of spaced ears or plates 133 welded to the rear flange of the beam 115. The cylinder 130 has a downwardly projecting piston rod 136 (FIG. 3) having a lower end portion connected to the ram 118 by a cross pin 137 extending through aligned holes within the side plates 123 of the ram.

The ram 118 is positioned rearwardly of and in alignment with the plow blade 50 so that the ram moves vertically in a path directly above the folded fabric edge portion 12 within the slot in the ground formed by the plow blade 50 when the tractor is moving in a straight path. As shown in FIGS. 2 and 3, when the ram is forced downwardly by the cylinder 130, a stake 16 is pressed or forced or driven into the ground G. The steps produced by the angles 126 provide for driving stakes of different lengths, and the approximate 2' width of the steps or angles 126 provide for driving or inserting a stake 16 adjacent the folded edge portion 12 of the silt fence 10 while the tractor is on a curved path and the ram 118 is temporarily offset laterally relative to the folded edge portion 12 of the silt fence.

Figure 4:
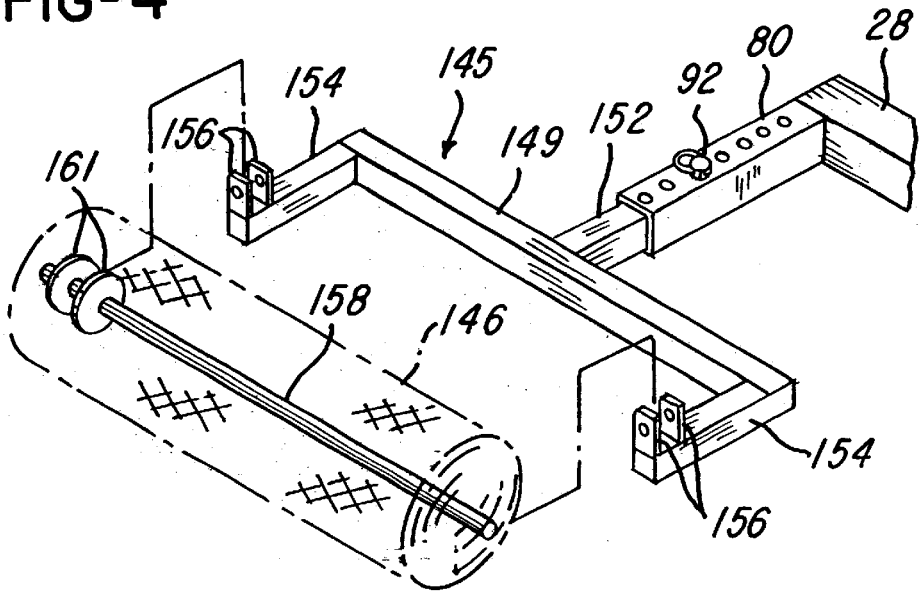
FIG. 4 is a perspective view of an optional attachment to the silt fence installing apparatus shown in FIG. 1 for supporting a roll of wire fence backing material.

Referring to FIG. 4, some installations of a silt fence require that the silt fence be attached to longitudinally spaced stakes 16 and also be backed up by a metal wire fence. The apparatus of the invention provides for an attachment support 145 for a roll 146 of wire fence. The support 145 includes a horizontal cross tube 149 welded to a tube 152 which telescopes into the left support tube 80 for the roll 90 of silt fence material. A pair of parallel spaced arms 154 project rearwardly from the cross tube 149, and a pair of ears or flanges 156 project upwardly from the rearward end portion of each arm 154 for receiving a horizontal support tube or shaft 158 extending through the center of the wire fence roll 146. A pair of spaced discs 161 are welded to the left end portion of the shaft 158 and receive the corresponding arm 154 therebetween to prevent axial movement of the shaft 158 relative to the roll 146 after the shaft 158 is positioned between the pairs of ears or flanges 156. Preferably, the right end portion of the roll 146 overlaps the portion 14 of the silt fence 10 while lying on the ground so that the unrolled wire fencing may be tilted to a vertical position and positioned adjacent the stakes 16 prior to lifting the horizontal portion 14 of the silt fence 10 to a vertical position adjacent the stakes 16. As a result, the wire fence is located between the silt fence and the posts after which they are attached to the stakes by wire ties or wire.

Figure 5:
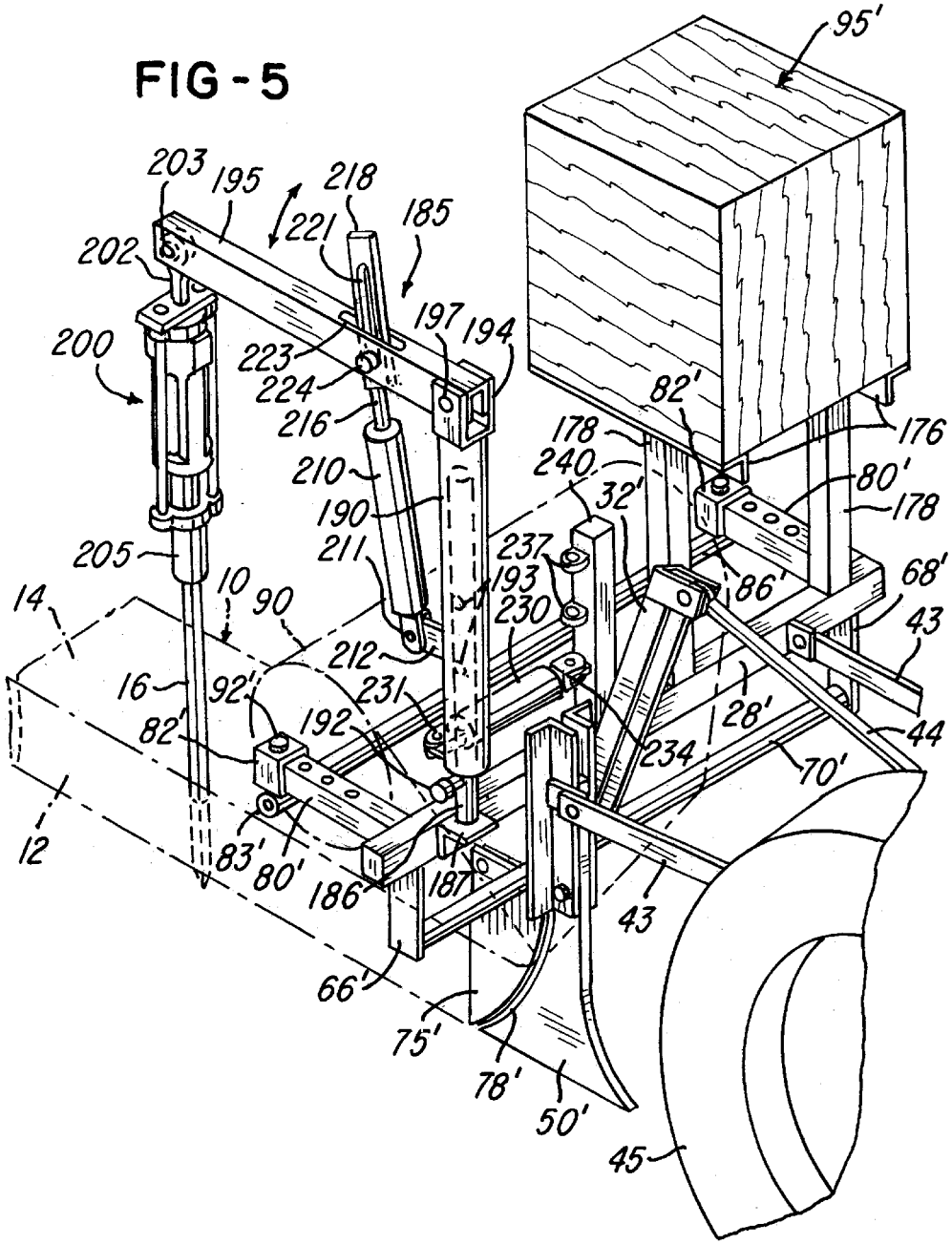
FIG. 5 is a perspective view of a modified form of the silt fence installing apparatus combined with another form of stake driver supported by the silt fence installing apparatus in accordance with the invention.
Figure 6:
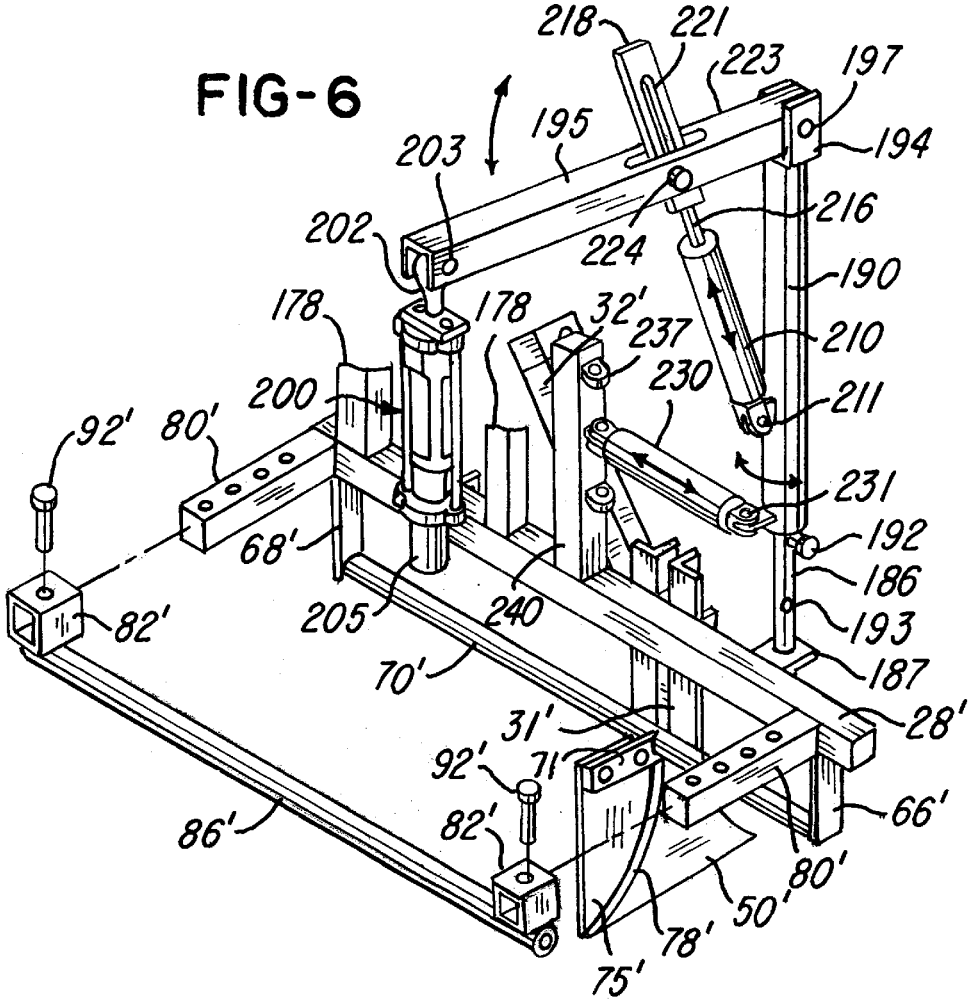
FIG. 6 is a rear perspective view of a portion of the apparatus shown in FIG. 5 and with a component exploded therefrom.

FIGS. 5 and 6 illustrate another embodiment of a combined silt fence installing apparatus and stake driver constructed in accordance with the invention and wherein corresponding components of the silt fence installing apparatus have the same reference numbers as in FIGS. 1–3, but with the addition prime marks. In this second embodiment, a supply of stakes is stored within and carried by a container or box 95' supported by parallel spaced horizontal angles 176 welded to the top ends of a pair of vertical support posts 178 having bottom ends welded to the top of the cross tube 28'. The embodiment of FIGS. 5 and 6 also incorporates a stake driver assembly 185 which includes a tubular support column or post 186 having a lower end welded to an angle bracket 187 which is welded to front surface of the cross tube 28'. A larger cylindrical tube or post 190 telescopes onto the smaller post 186 and may be adjusted vertically on the post 186 to selectable different levels where it is retained by a cross pin 192 projecting through one of a series of vertically spaced holes 193 within the post 186. A U-shaped bracket 194 is welded to the top end of the tubular post 190 and pivotally supports the forward end portion of an arm or boom 195 by a cross pin 197.

The boom 195 projects rearwardly over the supply roll 90 of silt fence material, normally in generally the vertical plane of the plow blade 50'. The rearward end portion of the boom 195 supports a hydraulically operated jack or impact hammer 200. One form of hydraulic impact hammer 200 which has provided satisfactory results is manufactured and sold under the trademark FAIRMONT as a sign post driver. The impact hammer 200 is supported in a suspended position by a swivel fitting 202 having an upper end portion enclosing a spherical bearing retained by a cross pin 203 to permit universal and rotatable movement of the hammer 200. The lower end portion of the hammer 200 carries an interchangeable tubular collar or head adaptor 205 which receives the upper end portion of a stake 16. The adaptor 205 may have substantial length in order to confine a substantial portion of the stake 16 to assure that the stake is maintained in a substantially vertical position while the stake is being driven into the ground.

A hydraulic lift cylinder 210 has a lower end portion pivotally connected by a cross pin 211 to a plate 212 welded to the rear side of the tubular support post 190. The cylinder 210 includes a piston rod 216 which is secured to the lower end of an elongated plate 218 having a longitudinally extending slot 221 and projecting through a vertical slot 223 within the boom 195. A cross pin 224 extends through the boom 195 and the slot 221 and provides for lifting or tilting the boom 195 when the hydraulic cylinder 210 is actuated to extend the piston rod 216 upwardly and thereby lift the hammer 200 on its vertical axis.

A horizontally extending hydraulic cylinder 230 has a piston rod pivotally connected by a vertical pin 231 to a horizontal plate welded to a lower end portion of the tubular support post 190. The cylinder 230 is supported by a U-shaped bracket 234 which is connected by a cross pin to one of a series of vertically spaced ears 237 projecting laterally from a vertical support post 240 welded to the top of the cross tube 28'. Actuation of the cylinder 230 is effective to rotate the tubular support post 190 and the boom 195 on the vertical axis of the post 186 in order to position the impact hammer 200 directly over the folded edge portion 12 of the silt fence 10. When it is desired to elevate the post 190 to adjust the level of the boom 195 and the hammer 200 to accommodate longer stakes 16, the cylinder 230 is also elevated and attached to another ear 237. The spacing between the ears 237 correspond to the spacing of the holes 193 so that the cylinder 230 remains horizontal in the different elevated positions of the outer support post 190.

In operation of the stake driver apparatus or assembly 185, the tractor and silt fence installing apparatus advances in increments corresponding to the desired spacing of the stakes 16. The hammer 200 is lowered by actuation of the cylinder 210 until the tubular hammer collar 205 receives a stake 16 and rests on the top end of the stake which is ready to be pressed or inserted into the ground adjacent the folded edge portion 12 of the silt fence material 10. The piston rod 216 of the cylinder 210 is then fully retracted, and the weight of the hammer 200 and one half the weight of the boom 195 is effective to drive the stake into the ground when the hydraulic impact hammer 200 is operated. After a stake 16 is driven into the ground to the desired depth, the cylinder 210 is actuated to lift the boom 195 and hammer 200 in order to remove the tubular collar 205 from the stake 16. The tractor, the silt fence installing apparatus and the stake driver assembly 185 are then moved or advanced forwardly by a distance corresponding to the desired spacing between adjacent stakes 16, and the operation is repeated.

From the drawings in the above description, it is apparent that the combined silt fence installing apparatus and stake driver apparatus constructed in accordance with the invention, provides desirable features and advantages. For example, with either the apparatus shown in FIGS. 1–3 or in FIGS. 5 and 6, each stake 16 may be driven into the ground adjacent the folded edge portion 12 of the silt fence 10 immediately after the folded edge portion is inserted into the ground and directly behind the supply roll 90. This provides for a one pass operation of the combined apparatus and for effeciently installing the silt fence and its supporting stakes. In addition, the length of the step angles 126 (FIG. 1) or the rotation of the boom 195 and hammer 200 (FIG. 5) provides for precisely inserting the stakes 16 adjacent the folded edge portion 12 when the tractor is turning or following a curved path and the vertical axial plane of the stake 16 is offset from the vertical plane of the plow 50 or 50'. In addition, the box 95 or 95' provides a convenient supply of stakes to the operator of the hydraulic cylinder 130 or the impact hammer 200 so that a stake 16 is conveniently accessible for insertion into the ground during each stop of the tractor and the silt fence and stake installing apparatus.

While the forms of apparatus herein described constitute preferred embodiments of the invention, it is to be understood that the invention is not limited to these precise forms of apparatus, and that changes may be made therein without departing from the scope and spirit of the invention as defined in the appended claims.

What is claimed is:

1. Apparatus for efficiently inserting a longitudinal edge portion of an elongated flexible silt fence material into the ground and for inserting stakes into the ground adjacent the silt fence at longitudinally spaced intervals, comprising a frame adapted to be moved by a tractor along the ground, a support on said frame for supporting a supply roll of silt fence material, a generally vertical plow blade mounted on said frame for cutting a slot within the ground in response to forward movement of the frame along the ground, a silt fence inserting member supported by said frame rearwardly of said plow for receiving an intermediate portion of the silt fence material and for progressively guiding a folded edge portion of the silt fence material into the slot formed within the ground by said plow blade, a hydraulically actuated stake driver for pressing an elongated stake into the ground, and a support member mounted on said frame and supporting said stake driver for generally vertical movement rearwardly of said support for the supply roll and above the folded edge portion of the silt fence.

2. Apparatus as defined in claim 1 and including a storage member mounted on said frame for supporting and storing a supply of the stakes for removal from the rear of said apparatus.

3. Apparatus as defined in claim 1 and including a generally horizontal shaft for receiving the supply roll of flexible silt fence material, and said frame having members supporting said shaft for generally horizontal and lateral adjustable movement relative to said plow blade.

4. Apparatus as defined in claim 1 and including a wire fence support member projecting rearwardly of said frame and having a generally horizontal shaft adapted to support a roll of metal wire fence.

5. Apparatus as defined in claim 1 wherein said stake driver comprises a ram supported by a generally vertical track and having a plurality of vertically spaced stake engaging steps adapted to accommodate stakes of different lengths, and a hydraulic cylinder for moving said ram along said track.

6. Apparatus as defined in claim 5 wherein each of said stake engaging steps is elongated to provide for driving a stake into the ground adjacent the folded edge portion of the silt fence when said apparatus is being moved along a curved path on the ground.

7. Apparatus as defined in claim 1 wherein said stake driver comprises a hydraulically actuated impact hammer, and said support member includes a generally horizontally extending boom extending rearwardly of said frame and supporting said impact hammer.

8. Apparatus as defined in claim 7 wherein said support member includes a generally vertically adjustable telescopic post mounted on said frame and supporting said boom for pivotal movement on a generally horizontal axis, and hydraulic cylinders connected to pivot said boom and rotate said post at selected different elevations.

9. Apparatus for efficiently inserting a longitudinal edge portion of an elongated flexible silt fence material into the ground and for inserting stakes into the ground adjacent the silt fence at longitudinally spaced intervals, comprising a frame adapted to be moved by a tractor along the ground, a laterally extending support on said frame for supporting a supply roll of silt fence material, a generally vertical plow blade mounted on said frame for cutting a slot within the ground in response to forward movement of the frame along the ground, a laterally extending guide bar for the silt fence material, a silt fence inserting member supported by said frame rearwardly of said plow for receiving an intermediate portion of the silt fence material directed around said guide bar and for progressively inserting a folded edge portion of the silt fence material into the slot formed within the ground by said plow blade, a hydraulically actuated stake driver for pressing an elongated stake into the ground, and a support member mounted on said frame and supporting said stake driver for generally vertical movement rearwardly of said support for the supply roll and generally in alignment with said plow blade.

10. Apparatus as defined in claim 9 and including a storage member mounted on said frame for supporting and storing a supply of the stakes for removal from the rear of said apparatus.

11. Apparatus as defined in claim 9 and including a generally horizontal shaft for receiving the supply roll of flexible silt fence material, and said frame having members supporting said shaft for generally horizontal and lateral adjustable movement relative to said guide bar.

12. Apparatus as defined in claim 9 and including a wire fence support member projecting rearwardly of said frame and having a generally horizontal shaft adapted to support a roll of metal wire fence.

13. Apparatus as defined in claim 9 wherein said stake driver member comprises a ram supported by a generally vertical track and having a plurality of vertically spaced stake engaging steps adapted to accommodate stakes of different lengths, and a generally vertical hydraulic cylinder for moving said ram along said track.

14. Apparatus as defined in claim 13 wherein each of said stake engaging steps is elongated to provide for driving a stake into the ground adjacent the folded edge portion of the silt fence when said apparatus is being moved along a curved path on the ground.

15. Apparatus as defined in claim 9 wherein said stake driver member comprises a hydraulically actuated impact hammer, and said support member includes a generally horizontally extending boom supporting said impact hammer.

16. Apparatus as defined in claim 15 wherein said support member includes a generally vertically adjustable telescopic post mounted on said frame and supporting said boom for pivotal movement on a generally horizontal axis, and hydraulic cylinders connected to pivot said boom and rotate said post at selected different elevations.

17. Apparatus as defined in claim 15 wherein said support member includes a generally vertically post mounted on said frame and supporting said boom for pivotal movement on a generally horizontal axis, and a hydraulic cylinder connected to pivot said boom.

18. Apparatus for efficiently inserting a longitudinal edge portion of an elongated flexible silt fence material into the ground and for inserting stakes into the ground adjacent the silt fence at longitudinally spaced intervals, comprising a frame adapted to be moved by a tractor along the ground, a support on said frame for supporting a supply roll of silt fence material, a generally vertical plow blade mounted on said frame for cutting a slot within the ground in response to forward movement of the frame along the ground, a silt fence inserting member supported by said frame rearwardly of said plow for receiving an intermediate portion of the silt fence material and for progressively guiding the edge portion of the silt fence material into the slot formed within the ground by said plow blade, a hydraulically actuated stake driver for pressing an elongated stake into the ground, a hydraulically operated support member mounted on said frame and supporting said stake driver for generally vertical movement, and a hydraulically operated cylinder connected to move said support member laterally.

19. Apparatus as defined in claim 18 and including a storage member mounted on said frame for supporting and storing a supply of the stakes.

20. Apparatus as defined in claim 18 and including a wire fence support member projecting rearwardly of said frame and having a generally horizontal shaft adapted to support a roll of metal wire fence.

* * * * *